US007686062B1

(12) United States Patent
Darnell

(10) Patent No.: US 7,686,062 B1
(45) Date of Patent: Mar. 30, 2010

(54) DUST BARRIER CURTAIN AND MOUNTING SYSTEM

(76) Inventor: Donald Lee Darnell, 1515 Ellen Ct., Auburn, CA (US) 95602

( * ) Notice: Subject to any disclaimer, the term of this patent is extended or adjusted under 35 U.S.C. 154(b) by 295 days.

(21) Appl. No.: 11/758,675

(22) Filed: Jun. 6, 2007

Related U.S. Application Data

(60) Provisional application No. 60/804,113, filed on Jun. 7, 2006.

(51) Int. Cl.
*A47H 1/00* (2006.01)

(52) U.S. Cl. ..... 160/330; 160/123; 160/89; 454/170

(58) Field of Classification Search ..... 160/330, 160/84.01, 84.03, 89, 123, 193, 338, 339, 160/348, 349.1, 350, 351; 454/170
See application file for complete search history.

(56) References Cited

U.S. PATENT DOCUMENTS

| | | | | |
|---|---|---|---|---|
| 2,609,043 | A * | 9/1952 | Dubinsky | 160/124 |
| 3,734,809 | A * | 5/1973 | Ellis | 428/12 |
| 3,863,554 | A * | 2/1975 | Boyd | 454/170 |
| 4,212,341 | A * | 7/1980 | Fisher | 160/84.04 |
| 4,733,710 | A * | 3/1988 | Haines | 160/84.06 |

* cited by examiner

*Primary Examiner*—Blair M. Johnson

(57) ABSTRACT

A curtain mounting system for creating a dust barrier that includes a curtain and a mounting system. The mounting system is made up of multiple support assemblies with each assembly having a holding member for attaching and supporting the curtain to a support structure such as wall or ceiling. The support assembly also has an elastic member coupled to the holding member and is also attached to the curtain. The elastic member is configured to suspend additional portions of the curtain creating an overlapping fold in the curtain. The curtain will lengthen when it is tugged on due to the curtain fold and will return back to its original length once the tugging has subsided due to the nature and placement of the elastic member.

19 Claims, 8 Drawing Sheets

DUST BARRIER CURTAIN AND MOUNTING SYSTEM

CROSS-REFERENCE TO RELATED APPLICATIONS

This application claims priority under 35 U.S.C. .sctn 119 to U.S. Provisional Application Ser. No. 60/804,113 entitled "Dust Curtain," which was filed on Jun. 7, 2006, the entire disclosure of which is hereby incorporated by reference.

FEDERALLY SPONSORED RESEARCH

Not Applicable

SEQUENCE LISTING OF PROGRAM

Not Applicable

BACKGROUND OF THE INVENTION

1. Field of Invention

For the do-it-yourself (DIY) folks working on various home or small business improvement projects that generate dust and flying debris and the like can be a real problem by migrating from the project area to the rest of the home or business. One example is the need to isolate a small work area in the center of a home kitchen in order to install a skylight. The dust and falling debris if not isolated would easily travel throughout the rest of the kitchen and beyond getting on appliances, dishes, and even into closed cupboards.

A barrier is needed that solves the problem and does not create any additional work later. The typical DIY person is cost sensitive, does not want additional bulky project items to store, may or may not have a helper and does not usually have long blocks of un-interrupted time to complete a project and the project area may also be needed for other tasks at different times of the day, so being able to quickly stop, cleanup and resume a project as time permits is essential. Another desire of the DIY person is that the dust curtain does not fall down or tear if accidentally stepped on or caught by an object such as a ladder because the curtain does not adequately stretch.

The practice of nailing a board wrapped with disposable plastic sheeting satisfies the low cost desire for the DIY person, but fails in the areas of not creating additional work due to wall or ceiling repairing, may need a helper in holding up the board to be nailed, not being able to quickly stop, cleanup and resume the project due to the difficulty of installing and removing the nailed board. The curtain can also tear and fall down if accidentally stepped on or caught by a ladder. Likewise, using tape to adhere a curtain or plastic sheet to the walls and ceilings usually fails to stick and if it does, later removal can remove paint or leave an adhesive residue requiring cleanup.

2. Prior Art

In the prior art, there is disclosed a number of curtain wall structures and supports that address some of the issues and concerns of the DIY person, but still fall short in providing a complete solution.

In U.S. Pat. No. 4,794,974, Melino discloses a curtain wall having spring-loaded support legs attached to a support header. A curtain is fastened to the header along the length of the header. This design suffers from several limitations. Increased manufacturing costs due to the materials and workmanship needed for construction of the poles, headers and fasteners. Installation appears to be awkward and time consuming due to the multitude of parts needed to erect the curtain and the system appears to be top-heavy during installation.

In U.S. Pat. No. 6,152,434, Gluck discloses a curtain wall which is supported by poles that incorporate a user adjustable locking arm so the user can adjust the tension for securing the pole and curtain between the floor and ceiling. This design also suffers from increased manufacturing costs due to materials and workmanship and is bulky and difficult to store when not in use. This design holds the curtain securely and does not allow for the curtain to adequately stretch in case it is accidentally stepped on or caught by an object such as a ladder without tearing the curtain or pulling down the assembly.

In U.S. Pat. No. 5,345,989, Brophy barrier curtain for an opening surrounded by walls incorporating multiple carriers that clamp onto walls edges of an opening and is used for creating a tight dust proof covering over the opening. This design is limited because it only "seals off" an opening that is surrounded by walls in order to be able to clamp the attaching system to the walls in order to suspend the curtain from.

These patents don't satisfy all the needs of not falling down or tearing when stepped on or caught by an object such as a ladder, being low cost, not requiring storage of bulky poles, being more than just a barrier for an opening and being able to quickly stop, cleanup and resume a project as time permits.

3. Objects and Advantages

In view of the above problems, an ideal solution would include a method of preventing the dust barrier curtain from falling down if tugged or stepped on; a method that allows for quick installation and removal of the dust barrier curtain; a method of supporting the barrier curtain that does not require bulky, expensive, hard to store long poles; a method of protecting from or containing dust and debris in an enclosure; physical unit encompassing the outlined features would be portable, low-cost, small (i.e., hand held) and lightweight.

Therefore, a primary object of the present invention is to provide a curtain and mounting system that is designed to "give" when stepped on or caught by some object like a ladder instead of trying to resist such external forces.

Another primary object of the present invention is to provide a curtain and mounting system that can be quickly installed and removed while minimizing additional repair work later caused by the installation and removal of the curtain.

Another primary object of the present invention is to provide a curtain and mounting system that can easily be transported and does not require much storage space when not in use and is lightweight.

Another primary object of the present invention is to a provide flexible mounting system that can adapt to different length curtains or provide more or less curtain support depending on the user needs.

Another primary object of the present invention is to contain or keep out dust and debris even when the curtain is being stepped on or caught by some object like a ladder.

Another primary object of the present invention is to be able to protect the floor besides the vertical surfaces and contain some spills by connecting the curtains to a floor panel using a ziplock or other profile strip type or hook and loop type fasteners.

Another primary object of the present invention is to be able to protect the ceiling besides the vertical surfaces and floor surface by connecting the an additional floor panel using a ziplock or other profile strip type or hook and loop type fasteners to the top of the curtains.

Another primary object of the present invention is to be able to securely join multiple curtains and panels together to protect larger areas by connecting the curtains and panels using a ziplock or other profile strip type or hook and loop type fasteners.

According to the present invention, these objectives are attained by an apparatus incorporating stretching bands into a one-piece and two-piece dust barrier curtain or allowing stretch bands to be easily combined with different curtain materials and different lengths of curtains. Strips of soft plastic foam are incorporated along the curtain edges that touch walls and ceiling to further reduce the migration of dust and debris. The use of ziplock or other profile strip type or hook and loop type fasteners used between the curtain edges create more secure connections and allow for expandability. A floor panel that can connect to the curtains using ziplock or other profile strip type or hook and loop type fasteners will produce a near waterproof connection, whereby protecting the walls and floor. The same floor panel can also be used as a ceiling by connecting to it the top of the curtain. Still further objects and advantages will become apparent from a consideration of the ensuing description and drawings.

SUMMARY

The present invention relates to a curtain mount apparatus and method which overcome the limitations of the prior art. The curtains form a temporary wall or enclosure in which the project is done or, alternatively, an enclosure or wall in which objects are protected from dust and debris and may be used to prevent contaminants such as paint and odor from entering clean areas in a home or office. To keep the curtain up when stepped on or tugged, each curtain will typically include a support assembly containing a holding member such as a small push pin for attaching the curtain to a support structure such as wall or ceiling and a elastic member such as stretching band (like a rubber band) connected to the holding member and passes through a sleeve in the curtain and then attached to the curtain, forming folds or pleats (like a roman shade) in the curtain. Alternatively the curtain could contain a single fold instead of multiple folds or pleats by eliminating the sleeve thereby allowing the use of standard plastic sheeting and reducing manufacturing costs. The combination of the pleats or a single fold and the stretching bands provides the "give" in the form of additional curtain length that keeps the curtains up when stepped on or pulled on. The present invention also relates to enclosing DIY projects that may span more than one weekend—to easily and quickly put up and take down the enclosures so that residents may continue to utilize the space for other activities besides the project. An example of this would be a three weekend long project to install a skylight in a kitchen: one would need to be able to use the kitchen during the "work week" and continue the skylight installation on the weekends. In an area like the kitchen it is critical to contain the drywall dust, insulation from the attic, sawdust from cutting through the roof, etc. from the food preparation areas.

In the preferred embodiment of the invention, the present invention allows for enclosures and walls to be quickly set up and removed using a two-piece curtain, made of flexible sheeting such as a low cost polymeric material, consisting of a short curtain (approximately ¼ the desired length of the overall desired curtain length and a long curtain making up the other ¾ of the desired curtain length. The short curtain with multiple built-in support assemblies whereby each assembly has a holding pin installed in the top of the short curtain edge coupled with one end of the stretching band and the other end of the band passing through the built-in sleeve located in the curtain and attached near the bottom of the curtain using the anchor assembly with the alligator type clip hanging down. With the stretching band in a relaxed a position, portions of the curtain will form multiple folds (pleats) around the curtain sleeve.

The short curtain would install first by attaching the combined curtain and multiple support assemblies to the ceiling by pushing the holding member into the ceiling thereby supporting the short curtain and stretching bands. When the user is ready to begin work, the long curtain with its reinforced dust seal top edge can be quickly and securely held by the alligator type clips found near the bottom edge of the short curtain thereby suspending the long curtain and creating an enclosure or wall and work can be started. When the enclosure or wall needs to be removed, the long curtain is simply unclipped and put away. The short curtain remains in place and out of the way. When the enclosure is needed again, the long curtain can be quickly clipped back into plane.

In a second preferred embodiment of the invention, the two-piece curtain as described in the preferred embodiment is enhanced with complementary ziplock or other profile strip type seal, or a hook and loop type seal, on each curtain edge (male on one side and female on the other). Thus, the curtain edges can be joined to each other to create wider and longer enclosures of many sizes and shapes. These seals will help keep dust/debris in (or out, as needed). To further aid in creating a more dust proof enclosure a floor panel composed of low cost polymeric material with laminated complementing ziplock or other profile strip type or a hook and loop type seal on its edges could be attached to the bottom of the long curtains. Likewise, another floor panel can be used as a ceiling panel by connecting the edges of the panel to the top of the short curtain.

In an alternative embodiment, the invention comprises a single-piece curtain made of flexible sheeting such as a polymeric material. The curtain does not have any fabricated sleeves so as to reduce manufacturing cost, but can include a dust seal strip built into the top edge of the curtain. The curtain with its built-in support assemblies will have each assembly's holding pin installed in the top of the short curtain edge with the coupled stretching band stretched vertically extending downward approximately ¼ the length of the curtain and attached to the curtain using the anchor assembly. With the stretching band in a relaxed position a portion of the curtain will form a single fold.

The curtain would install by attaching the combined curtain and multiple support assemblies to the ceiling by pushing the holding member into the ceiling thereby supporting the curtain and stretching bands. The user would be ready to work. When the enclosure or wall needs to be removed, the curtain would be removed by pulling out the holding members.

The curtain can be enhanced with laminated complementing ziplock or other profile strip type seal, or a hook and loop type seal, on each curtain edge (male on one side and female on the other). Thus, the curtain edges can be joined to other curtains in order to create wider and longer enclosures of many sizes and shapes. These seals will help keep dust/debris in (or out, as needed). To further aid in creating a more dust proof enclosure a floor panel consisting of plastic sheeting with ziplock or other profile strip type or a hook and loop fastener type seal on its edges could be attached to the bottom of the curtains. Likewise, another floor panel can be used as a ceiling panel by connecting the edges of the panel to the top of the curtain.

The embodiments indicate that the support assembly is built into the curtain along with the anchor assembly. To save cost, it is anticipated that the support assembly with the anchor assembly could be sold as a standalone product or not automatically built-in to a product, but require the user to assemble the curtain. It is also anticipated that the anchor assembly can be eliminated as a cost savings idea and the stretch band with and without the alligator type clip can be directly attached to the curtain, for example by using an adhesive such as an epoxy or with a rivet.

DRAWINGS

Figures

REFERENCE NUMERALS

Figure 1:
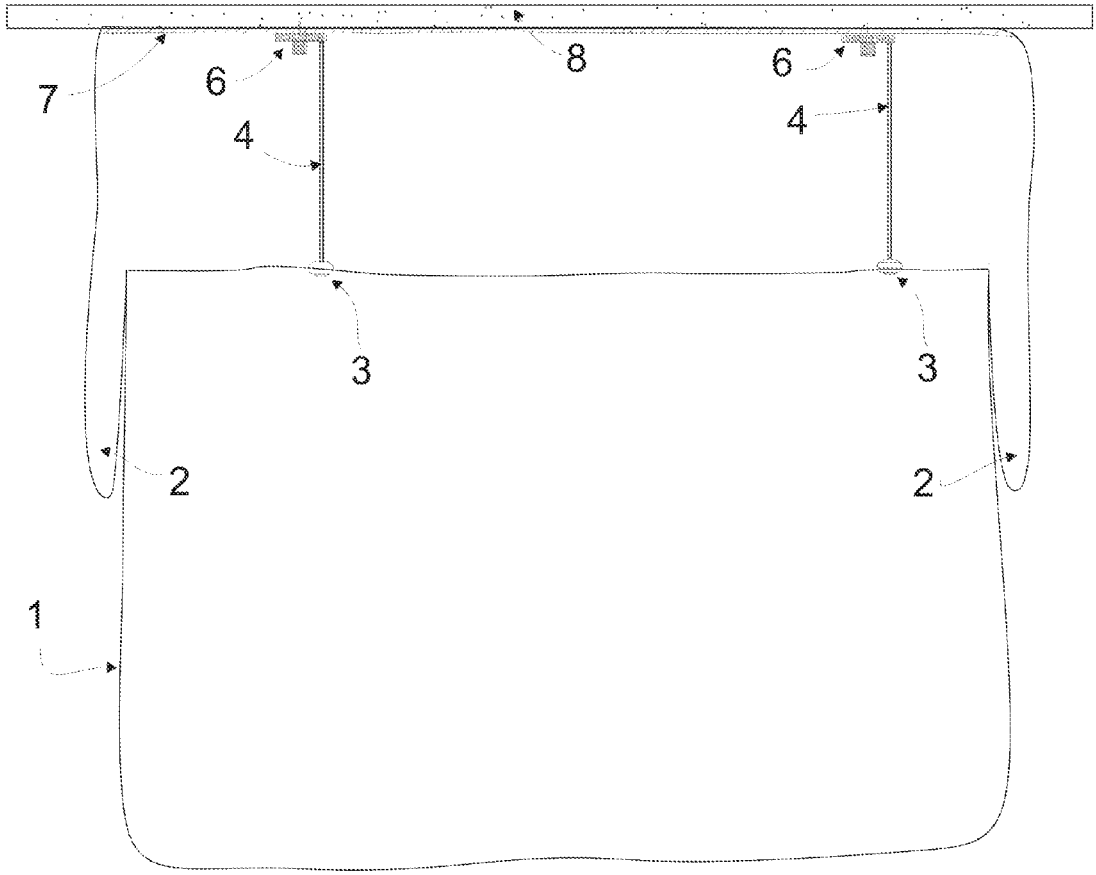
FIG. 1 is a view of an alternate form of a curtain mounting system with a one-piece curtain that is shown attached to a ceiling and the stretching bands are in a relaxed state.

1 Curtain
2 Curtain pleat/fold
3 Anchor assembly
4 Stretch band
5 Sleeve
6 Support assembly
7 Dust seal
8 Ceiling section
9 Alligator type clip
10 Long curtain
11 Long curtain dust seal
12 Male side ziplock or hook and loop type fasteners
13 Female side ziplock or hook and loop type fasteners
14 Floor panel
15 Short curtain

DETAILED DESCRIPTION OF THE INVENTION

Figure 2A:
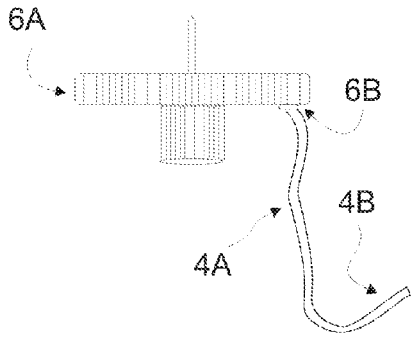
FIG. 2A is a detailed view of the support holding pin with attached stretching band.

Referring to FIG. 2A, shows a drawing of the curtain support assembly including the holding member (6A), the elastic member (4A) and approximately where the elastic member is attached to the holding member using a fastener such as a rivet (6B). The holding member can be composed of hard plastic with a metal pin and is similar in size to a standard push pin, but with a flat disc shaped brim to provide more surface area to support the curtain material. The elastic member in the form of a stretching band (4A) with a first and second ends is composed of an elastic member like a rubber band and the first end is attached (6B) to the holding member (6A) near the far end the flat disc shaped brim being approximately 1 inch in diameter and using a rivet or some other holding means. The stretching band is approximately ⅛ of an inch in diameter and approximately 10 inches long. The second end (4B) of the stretching band can be directly attached to the curtain using a connection member such as an adhesive or rivet.

Figure 2C:
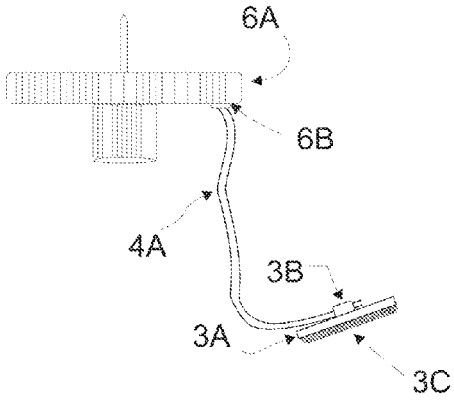
FIG. 2C is a detailed view of the support holding pin with attached stretching band and anchor assembly.
Figure 2B:
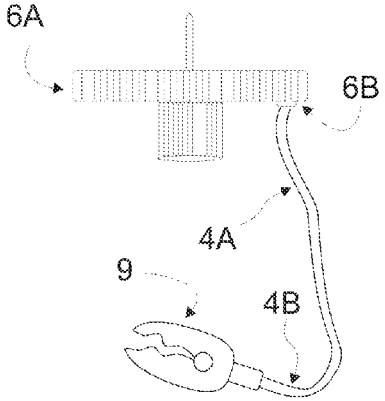
FIG. 2B is a detailed view of the support holding pin with an attached stretching band and alligator type clip.

Referring to FIG. 2B, shows the same described support assembly in FIG. 2A and includes an alligator type clip (9) with the inner surface of the clip being fastened to the second end of the elastic member (4A) using a fastener such as a crimp. A portion of the second end (4B) of the stretching band can also be directly attached to the curtain using a connection member such as an adhesive or rivet.

Referring to FIG. 2C, shows the same described support assembly in FIG. 2A and includes the anchor assembly (3) which attaches the second end of the stretching band (4A) to the curtain. The assembly has a plate (3A) composed of a hard plastic or cardboard disc and is approximately 1.5 inches in diameter and approximately 1/16 inch thick. The second end of the stretching band is secured to the top of the plate (3A) using a rivet or some other holding means (3B) and an adhesive strip (3C) is located on the bottom of the plate for attaching to the curtain.

Figure 2D:
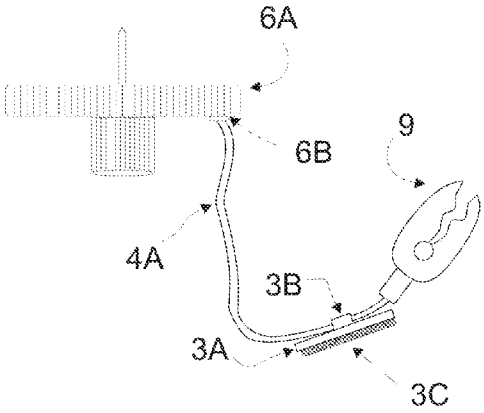
FIG. 2D is a detailed view of the support holding pin with an attached stretching band, anchor assembly and alligator type clip.

Referring to FIG. 2D, shows the same described support assembly in FIG. 2C but the second end of the stretching band (4A) extends out past the anchor assembly (3) a short distance from where it is secured on the plate (3B) and attaches to the an alligator type clip (9) with the inner surface of the clip being fastened to the second end of the elastic member (4A) using a fastener such as a crimp.

Referring to FIGS. 1 2C shows an alternative embodiment with multiple support (6) assemblies as shown in FIG. 2C, placed approximately one every two feet. The one-piece curtain (1) is composed of a polymeric material and is attached to a ceiling (8) using the holding member (6A) of support assembly (6) that has punctured the edge of the curtain (1) and has punctured the ceiling (8). The elastic stretching band (4) is configured vertically downward away from the support assembly (6). The anchor assembly (3) as shown in FIG. 2C is attached to the curtain (1) using the adhesive strip (3C) and is positioned at least twice the length of the relaxed elastic stretching band (4) thereby forming a fold (2) when the elastic stretching band (4) returns to its relaxed length. The top edge of the curtain (1) is reinforced with a soft plastic foam strip (7) which is approximately ½ inch wide and ⅛ of an inch thick and is laminated to the curtain (1) is also punctured by the holding member (6A) of the support assembly (6) to aid in creating a dust seal with the curtain and ceiling.

Figure 3:
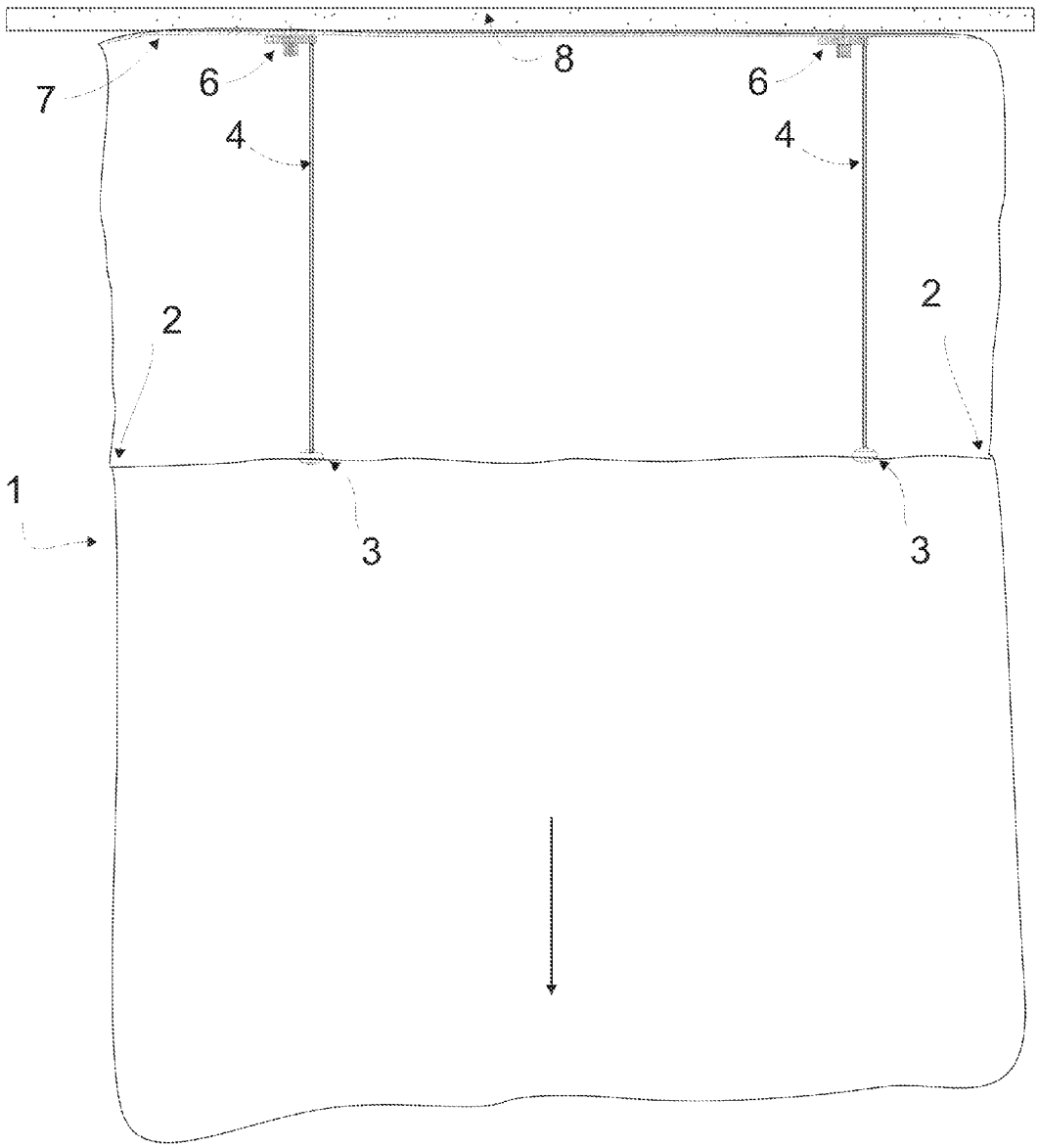
FIG. 3 is a view of an alternate form of a curtain mounting system with a one-piece curtain attached to a ceiling with the stretching bands extended and the fold stretched out.

Referring to FIG. 3 shows the alternative embodiment as described in FIG. 1 with the curtain (1) in a stretched state where the curtain (1) is being pulled from the bottom and the fold (2) is shown stretched out as the stretching bands (4) lengthen, thereby lengthening the curtain (1) and providing "give".

Figure 4:
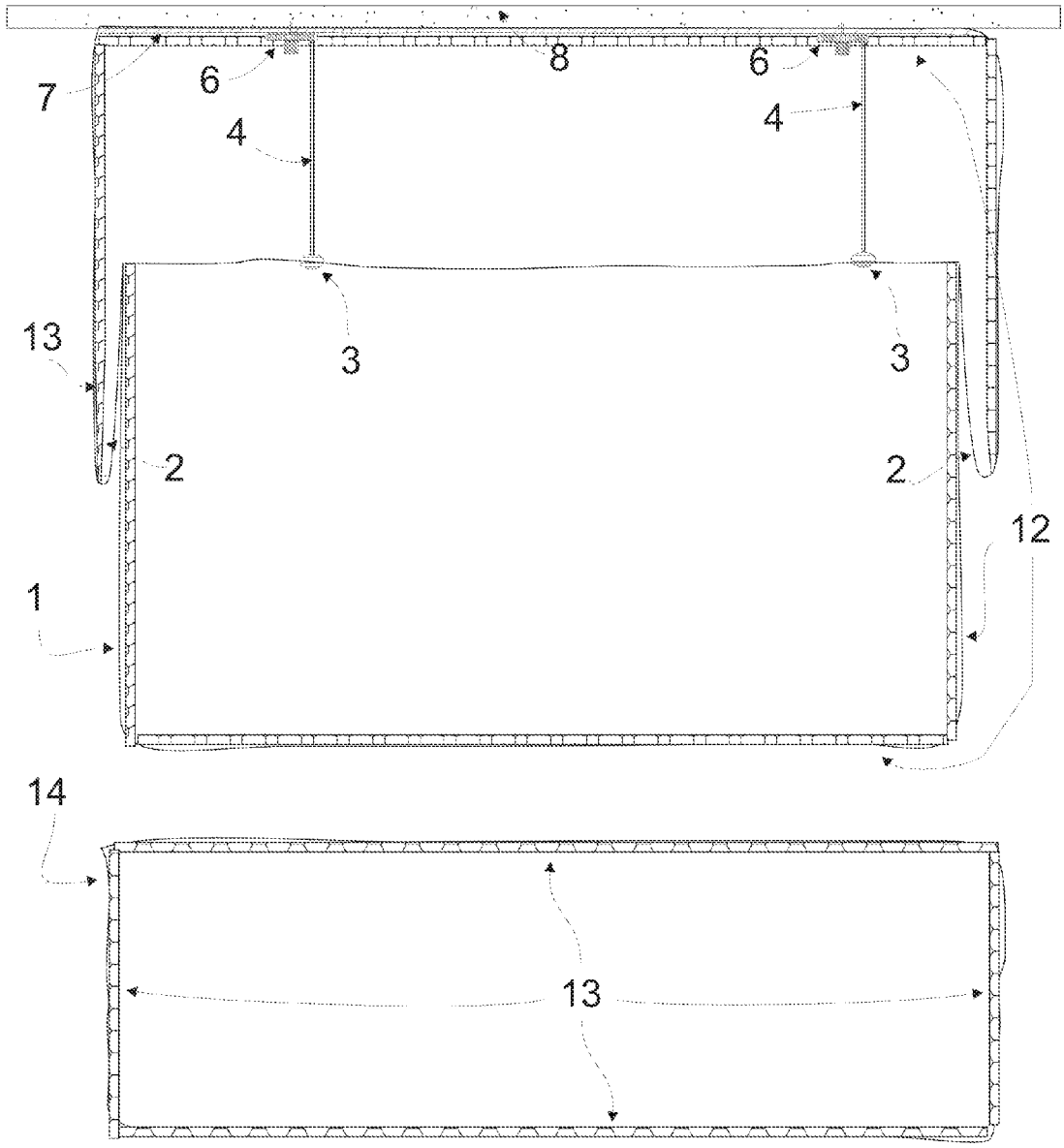
FIG. 4 is a view of an alternate form of a curtain mounting system with a one-piece curtain attached to a ceiling and a floor panel is shown with complementary ziplock or other profile strip type or hooks and loop type fasteners shown along the edges of the curtain and panel.

Referring to FIG. 4 shows the alternative embodiment as described in FIG. 1 but with the addition of ziplock or other profile strip type or hook and loop type fasteners laminated to the four edges of the curtain (1) which will allow for different configurations when combined with other curtains and it self. The male side (I.E. hook) of these fasteners is attached to the right side edge (13) of the curtain (1). The female side (I.E. loop) of these fasteners (12) is attached to the left side edge, top edge and bottom edge of the curtain (1). Multiple curtains (1) can be "zipped" or "hooked" together along their side edges thereby creating an extendable dust barrier or forming an enclosure using four curtains attached side-by-side. Also shown is a floor panel (14), composed of a polymeric material containing the same male side (I.E. hook) of the ziplock or other profile strip type or hook and loop type fasteners found in the curtain (1), laminated to all edges (13) of the panel so it will connect to the bottom edge of the curtain (1) creating a seal that will resist spills and the like. By suspending four curtains (1) in a side-by-side orientation, connecting the curtain (1) side edges and then connecting the edges of the floor panel (14) to the bottom edges of the curtains (1) it is then possible to create an enclosure (four walls and a floor) that will protect the floor and walls from spills. An additional floor panel (11) can also be used as a ceiling for the said enclosure by connecting the curtain (1) top edges to an additional floor panel (14) along its edges (13) thereby creating an enclosure with walls, floor and ceiling.

Figure 5:
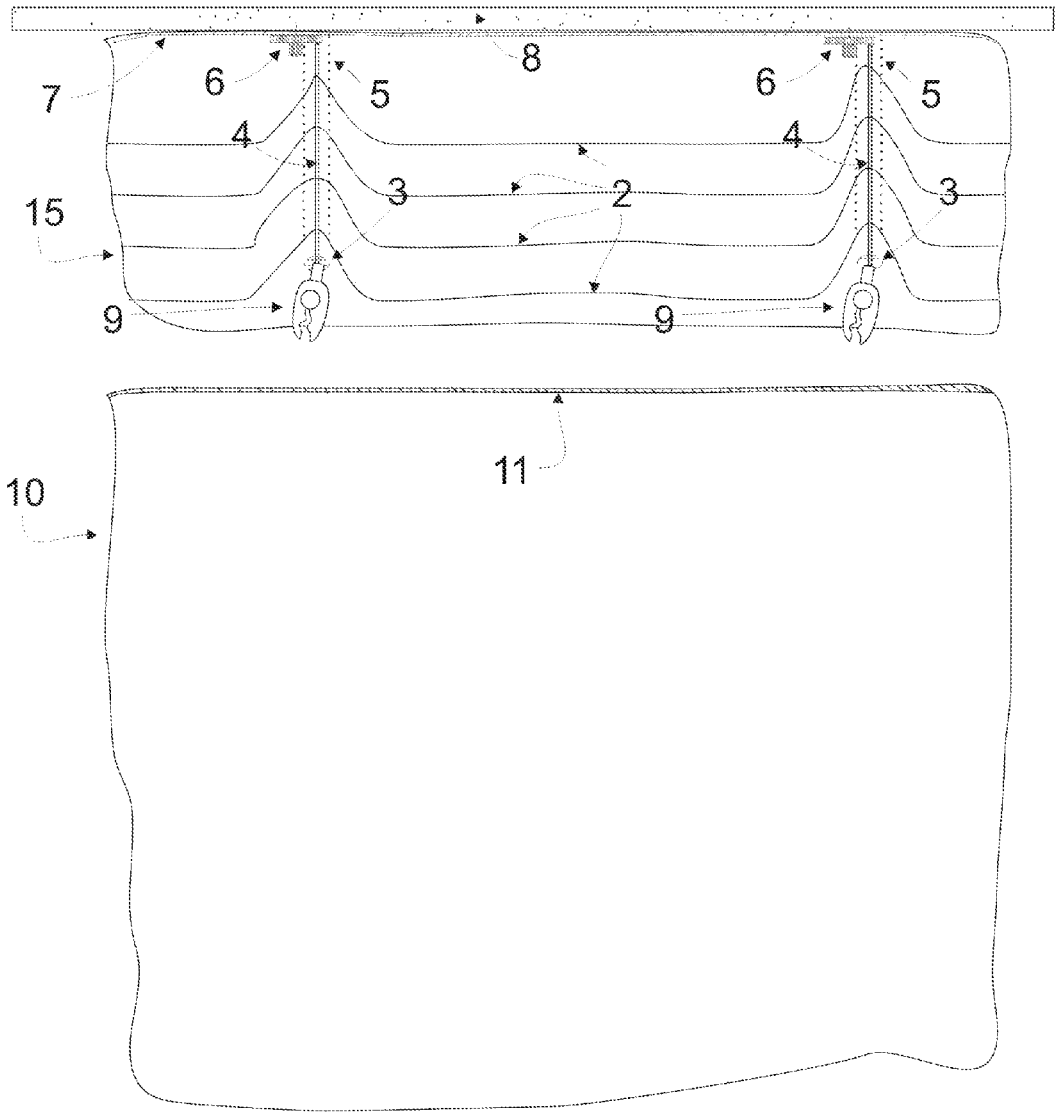
FIG. 5 is a view of a preferred form of a curtain mounting system with a two-piece curtain where the short curtain with clips is attached to a ceiling and a long curtain is shown.

Referring to FIGS. 5 2D shows the preferred embodiment with multiple support assemblies (6) as shown in FIG. 2D and placed approximately one every two feet and suspending a short curtain (15) attached to a ceiling and showing a long curtain (10). The short and the long curtains are composed of a polymeric material. The short curtain (15) is attached to the ceiling by puncturing the top edge of the short curtain (15) and puncturing the ceiling (8) using the holding member (6A) of the support assembly (6). The elastic stretching band (4) dropping down from the support assembly (6) freely passes through a flexible sleeve (5) formed out of the same polymeric material as the short curtain (15). The sleeve (5) has approximately a ½ inch diameter hole and is laminated to the short curtain (15). The anchor assembly (3) as shown in FIG. 2D is attached to the curtain (15) using the adhesive strip (3C) and is positioned at least twice the length of the relaxed elastic stretching band (4) thereby forming pleats (2) when the elastic stretching band returns to it's relaxed length. The top edge of the short curtain (15) is reinforced with a soft plastic foam strip (7) which is approximately ½ inch wide and ⅛ of an inch thick and is laminated to the short curtain (15) is also punctured by the holding member to aid in creating a good seal. Also shown is a long curtain (10) made out of polymeric material and the top edge of the curtain (10) is reinforced with a soft plastic foam strip (11) which is approximately ½ inch wide and ⅛ of an inch thick and is laminated to the curtain (10) to aid in creating a dust seal with the curtain and ceiling.

Figure 6:
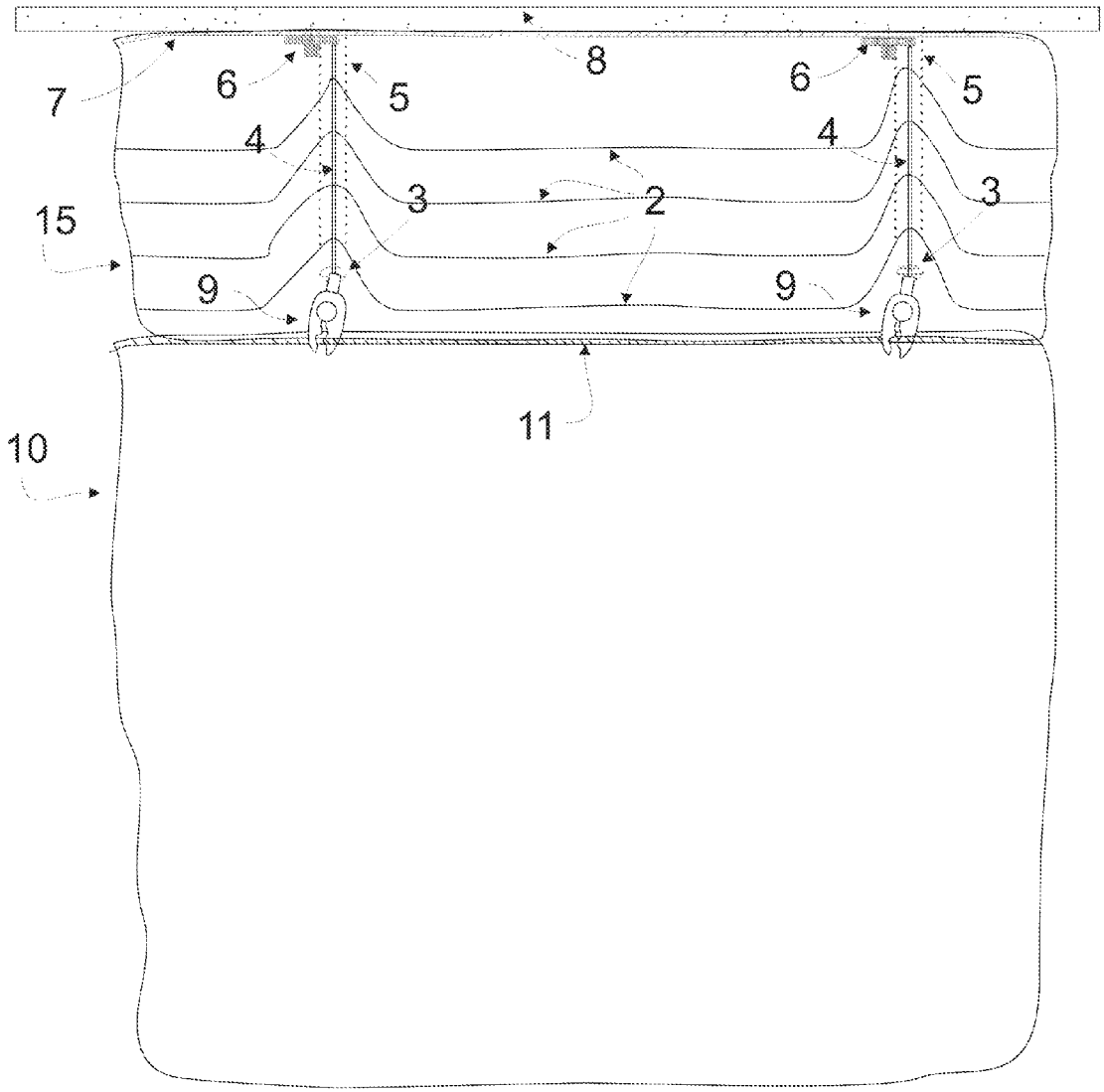
FIG. 6 is a view of a preferred form of a curtain mounting system with a two-piece curtain attached to a ceiling and the long curtain is attached to the short curtain using clips.

Referring to FIG. 6 shows the preferred embodiment as described in FIG. 5 with the reinforced edge (11) of the long curtain (10) being securely gripped by the clips (9) located at the bottom of the short curtain (15) so the bottom edge of the short curtain (15) overlaps the top edge of the long curtain (10) aiding in creating a better seal between the two curtains.

Figure 7:
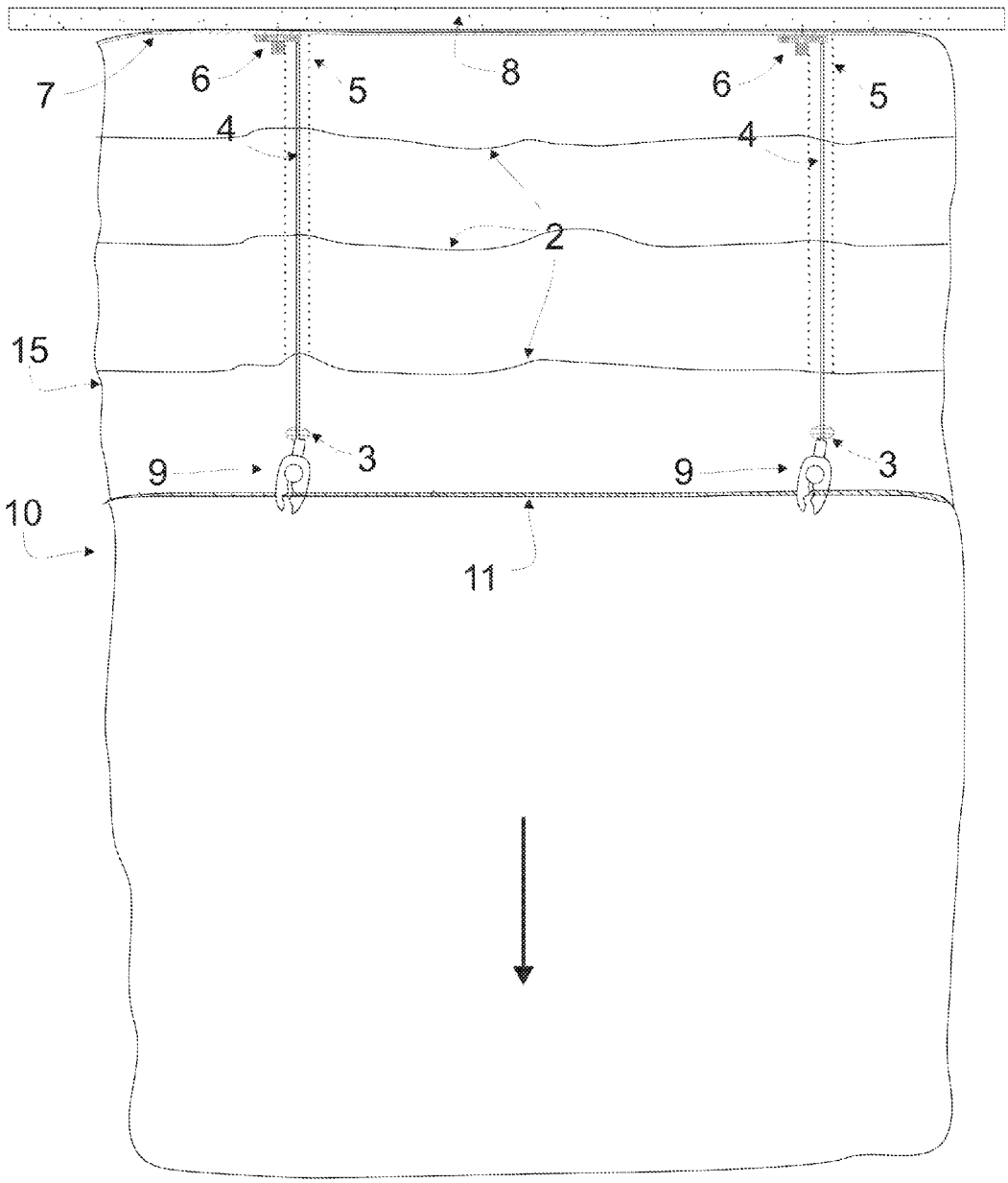
FIG. 7 is a view of a preferred form of a curtain mounting system with a two-piece curtain attached to the ceiling with the stretching bands extended and the pleats stretched out on the short curtain while supporting the long curtain using the clips.

Referring to FIG. 7 shows the preferred embodiment as described in FIG. 5 with the short curtain (15) in an extended state where the long curtain (10) is being pulled from the bottom and the pleats (2) are shown stretched out as the stretching bands (4) lengthen, thereby lengthening the short curtain (15) and providing "give".

Figure 8:
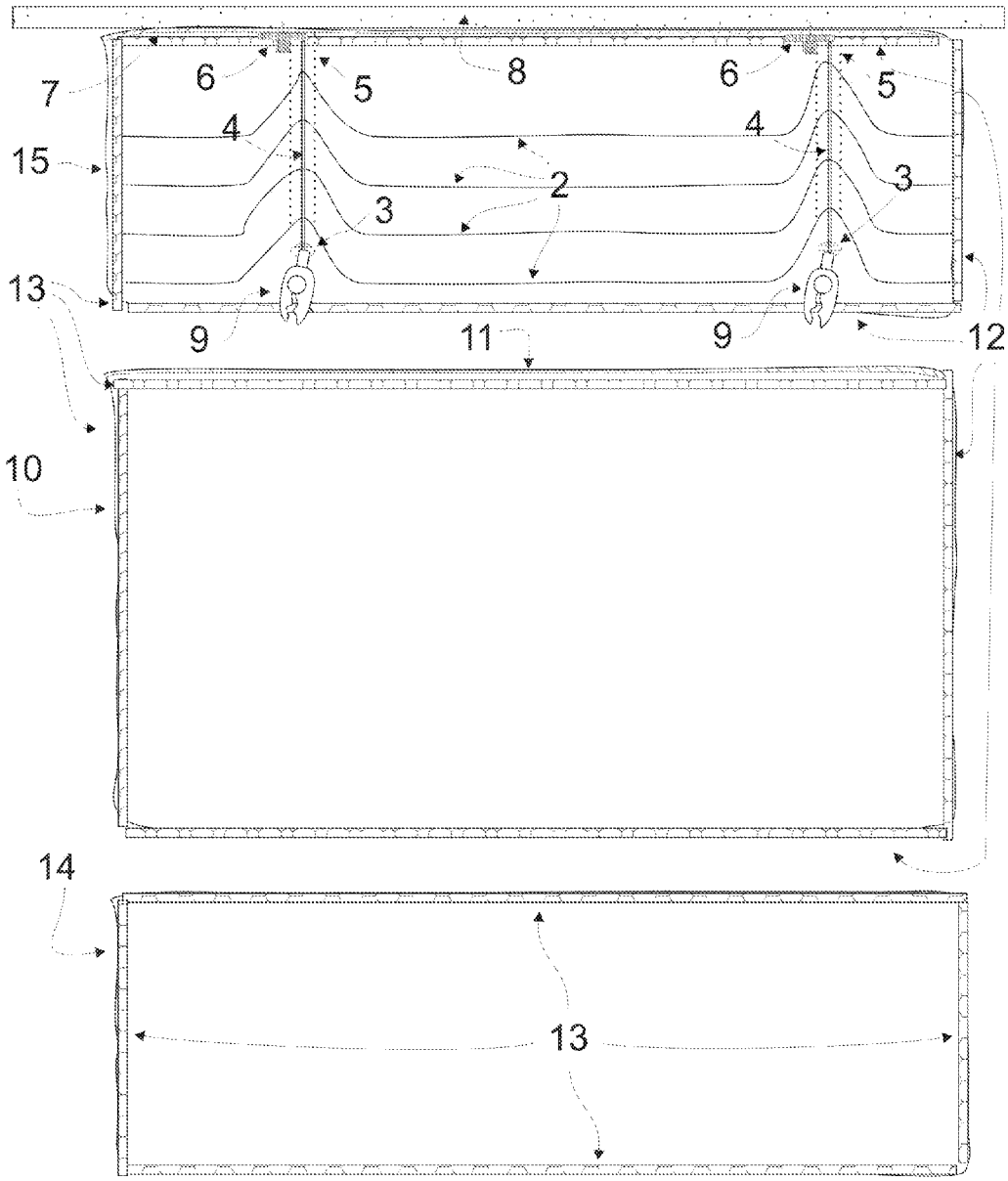
FIG. 8 is a view of a second preferred form of a curtain mounting system with a two-piece curtain and floor panel with ziplock or other profile strip type or hook and loop type fasteners along the edges of the curtains and panel.

Referring to FIG. 8 shows the second preferred embodiment, composed of the same characteristics as described for FIG. 5, but with the addition of ziplock or other profile strip type or hook and loop type fasteners laminated to the four edges of the short curtain (15) and the four edges of the long curtain (10) which will allow for different configurations when combined with other curtains and each other. The male side (I.E. hook) of these fasteners (13) is attached to the bottom and right edges of the short curtain (15) and on the right edge and bottom edge of the long curtain (10). The female side (I.E. loop) of these fasteners (12) is attached to the left side edge of the short curtain (15) and the top and left edge of the long curtain (10). When the long curtain (10) is joined to the short curtain (15) as shown in FIG. 6, then the mating fasteners (12) (13) between the bottom edge of the short curtain (15) can be "zipped" or "hooked" to the top edge of the long curtain (10) to provide better dust/debris sealing. Likewise, multiple short curtains (15) can be "zipped" or "hooked" together along their left and right side edges creating a wider short curtain. Similarly, multiple long curtains (10) can be hooked together on their side edges creating a wider long curtain. The floor panel (14), composed of low cost polymeric material, contains complementary ziplock or other profile strip type or hook and loop type fasteners (13) laminated to all edges of the panel so it will connect to the bottom edges of the long curtains (10) creating a seal that will resist spills and the like. By suspending four short curtains (15), attaching four long curtains (10) in a side-by-side orientation, connecting the side edges and then connecting the edges of the floor panel (14) to the bottom of the long curtains (10) then it is possible to create an enclosure (four walls and a floor) that will protect the floor and walls from spills. An additional floor panel (14) can also be used as a ceiling for the said enclosure by connecting the short curtain (15) top edges to an additional the floor panel (14) along its edges (13) thereby creating an enclosure with walls, floor and ceiling.

Although the invention has been disclosed in its preferred forms, the specific embodiments thereof as disclosed and illustrated herein are not to be considered in a limiting sense, because numerous variations are possible. The subject matter of the invention includes all novel and non-obvious combinations and sub-combinations of the various elements, features, functions, and/or properties disclosed herein. The following claims define certain combinations and sub-combinations of features, functions, elements, and/or properties that are regarded as novel and non-obvious. Other combinations and sub-combinations may be claimed through amendment of the present claims or presentation of new claims in this or a related application. Such claims, whether they are broader, narrower, equal, or different in scope to any earlier claims, also are regarded as included within the subject matter of the invention.

The invention claimed is:

1. A curtain mounting system for creating a barrier comprising:

a curtain having at least a top edge and a bottom edge and an original length which is the spacing between the top and bottom edges;

a mounting system including at least a plurality of support assemblies such that each assembly has at least a holding member for attaching and supporting the curtain to a support structure;

at least one elastic member so configured to suspend only a portion of said curtain between the top edge and the bottom edge of said curtain;

the elastic member having at least first and second ends;

the first end being coupled to the holding member; and the second end being coupled to a connecting member that attaches to said curtain between the top and bottom edges, thereby defining upper and lower curtain portions that overlap at least partially to define said original length wherein said curtain is allowed to lengthen without tearing, and after pulling down said lower portion of said curtain when said curtain is stepped on or other external force is applied by an object or person, the elastic member will return said curtain length to the original length once the external force is removed due to the nature and placement of said elastic member.

2. The curtain mounting system of claim 1, wherein the elastic member is a stretching band;

and the first end is fastened to the holding member using a fastener;

and the second end attaches to a connecting member.

3. The curtain mounting system of claim 2, wherein said connecting member further includes an anchor assembly comprising:

a plate having top and bottom surfaces with a fastener for attaching the second end of the elastic member to the top surface of the plate;

and an adhesive strip located on the bottom surface of the plate for attaching the plate to said curtain.

4. The curtain mounting system of claim 1, further including at least a dust seal between the top edge of the curtain and the support structure;

the dust seal being constructed of a resilient material in the form of a strip; and to further reinforce said curtain edge, the dust seal is disposed along the edge of said curtain.

5. The curtain mounting system of claim 1 further including hook and loop type fasteners attached to a plurality of curtain edges whereby allowing one or more said curtains to connect along said edges creating different curtain configurations.

6. The curtain mounting system of claim 5 further including one or more floor panels that have hook and loop type fasteners, attached to a plurality of edges wherein said floor panels edges connect along the edges of said curtain whereby creating a ceiling and a floor for an enclosure made up of multiple curtain walls and multiple floor panels.

7. The curtain mounting system of claim 1, wherein the holding member further includes a flat disc shaped brim push pin with the first end of said elastic member attached to the brim edge of said push pin.

8. A curtain mounting system for creating a barrier comprising:

a short curtain;

a long curtain;

a mounting system including at least a plurality of support assemblies such that each assembly has at least a holding member for attaching and supporting said short curtain to a support structure;

an elastic member so configured to suspend additional portions of said short curtain;

the elastic member having at least first and second ends;

the first end being coupled to the holding member; and the second end being coupled to a connecting member that attaches to said short curtain;

the second end also being coupled to a clipping member that is able to attach to and detach from said long curtain thereby forming a two piece curtain with a removable section and a curtain that is able to lengthen when tugged on due to said short curtain fold and return back to the original length once the tugging has subsided due to the nature and placement of said elastic member.

9. The curtain mounting system of claim 8, wherein the elastic member is a stretching band; and the first end is fastened to the holding member using a fastener; and the second end attached to a connecting member.

10. The curtain mounting system of claim 9, wherein said connecting member further includes an anchor assembly comprising:

a plate having top and bottom surfaces with a fastener for attaching the second end of the elastic member to said top surface of the plate;

and an adhesive strip located on said bottom surface of said plate for attaching said plate to the short curtain.

11. The curtain mounting system of claim 10 wherein said anchor assembly further includes a clipping member wherein the inner surface of the clip is fastened to the second end of the elastic member near said plate.

12. The curtain mounting system of claim 9, further including at least a dust seal between the top edge of the long curtain and the bottom edge of the short curtain;

the dust seal being constructed of a resilient material in the form of a strip; and to further reinforce said long curtain edge, the dust seal is disposed along the edge of said long curtain.

13. The curtain mounting system of claim 8, further including at least a dust seal between the top edge of the short curtain and the supporting structure;

the dust seal being constructed of a resilient material in the form of a strip; and to further reinforce said short curtain edge, the dust seal is disposed along the edge of said short curtain.

14. The curtain mounting system of claim 9 further including at least a sleeve attached to the short curtain so that the second end of the elastic member is in a stretched state;

the second end of the elastic member is configured vertically downward away from the holding member;

the second end of the elastic member passes through said sleeve; and the second end of the elastic member is attached to said short curtain using said connecting member whereby forming one or more folds or pleats in said short curtain when the elastic member is in a relaxed state.

15. The curtain mounting system of claim 8, wherein the connecting member further includes a clipping member wherein the inner surface of the clip is fastened to the second end of the elastic member.

16. The curtain mounting system of claim 8 further including hook and loop type fasteners attached to a plurality of edges of the short curtain and the long curtain whereby allowing one or more said curtains to connect along said edges creating multiple curtain configurations.

17. The curtain mounting system of claim 16 further including one or more floor panels that have hook and loop type fasteners attached to a plurality of edges wherein said floor panel edges connect along the edges of said long curtain and said short curtain whereby creating a ceiling and a floor for an enclosure made up of multiple curtain walls and multiple floor panels.

18. The curtain mounting system of claim 8, wherein the holding member further includes a flat disc shaped brim push pin with the first end of said elastic member attached to the brim edge of said push pin.

19. A method of installing a curtain mounting system for creating a temporary barrier comprising: a short curtain; a long curtain; a mounting system comprising a plurality of support assemblies such that each assembly comprises a holding member for attaching and supporting the short curtain to a support structure such as wall or ceiling; a elastic member so configured to suspend additional portions of the said short curtain and having first and second ends; with the first end coupled to the holding member; and the second end coupled to a connecting member that attaches to said short curtain and coupled to a clipping member that is able to attach and detach the said long curtain whereby forming a two piece curtain with a removable section and a curtain that is able to lengthen when tugged on due to said short curtain fold and return back to the original length once the tugging has subsided due to the nature and placement of the said elastic member.

* * * * *